United States Patent [19]

Dudley

[11] Patent Number: 4,889,748

[45] Date of Patent: Dec. 26, 1989

[54] DISPLAY DEVICE

[76] Inventor: Roger W. Dudley, 6647 Kerns Rd., Falls Church, Va. 22042

[21] Appl. No.: 184,376

[22] Filed: Apr. 21, 1988

[51] Int. Cl.[4] ..... A47G 33/08; G09F 1/10

[52] U.S. Cl. ..... 428/11; 40/158.1; 53/478; 428/13; 428/34.3

[58] Field of Search ..... 40/158.1; 53/478; 428/11, 13, 34.3

[56] References Cited

U.S. PATENT DOCUMENTS

| | | | |
|---|---|---|---|
| 1,693,561 | 11/1928 | Klein | 427/282 |
| 2,073,844 | 3/1937 | Lowenfels | 428/31 |
| 2,998,126 | 8/1961 | Jenkins | D6/302 X |
| 3,481,101 | 12/1969 | Steadman | 53/478 X |
| 3,522,673 | 8/1970 | Dudley | 428/13 X |
| 3,725,112 | 4/1973 | Hansen | 428/13 |
| 3,919,173 | 11/1975 | Coyner et al. | 521/123 X |
| 4,083,137 | 4/1978 | Rozmanith | 428/13 X |
| 4,087,570 | 5/1978 | Beinbrech | 427/44 |
| 4,100,010 | 7/1978 | Waugh | 428/42 X |
| 4,139,654 | 2/1979 | Reed | 427/44 |
| 4,145,001 | 3/1979 | Weyenberg et al. | 53/478 X |
| 4,173,667 | 11/1979 | Rusch | 428/11 |
| 4,224,364 | 9/1980 | Hunt | 428/11 |
| 4,263,734 | 4/1981 | Bradshaw | 428/13 X |
| 4,307,527 | 12/1981 | Suzuki | 428/13 X |
| 4,499,127 | 2/1985 | Jones | 428/14 |

*Primary Examiner*—Henry F. Epstein

*Attorney, Agent, or Firm*—Neil F. Markva

[57] ABSTRACT

The combination comprises rigid planar thin sheet substrate means. An envelope defined by sheets composed of transparent material and having an outer edge is secured on the rigid planar thin sheet substrate means. A postage stamp is disposed between the sheets within the envelope. The envelope is sealed along its outer edge to confine the postage stamp while allowing a visual examination of the postage stamp through the envelope. A clear material is disposed over the envelope to form a transparent dome-like structure through which the postage stamp may be viewed. A particular feature of the invention is a method for forming rigid first and second planar thin sheet substrate members. The first member is registered with and disposed within a recessed area on one displaying face of the second thin sheet substrate member.

17 Claims, 1 Drawing Sheet

DISPLAY DEVICE

FIELD OF THE INVENTION

This invention relates to display devices such as Christmas tree ornaments, medallion-like articles, and decorative emblems. More particularly, this invention is directed to an improvement in an encapsulated article and the method of making same as found in U.S. Pat. No. 3,522,673.

BACKGROUND OF THE INVENTION

Various devices for displaying items in an embedded manner are well-known as shown in my earlier U.S. Pat. No. 3,522,673. This earlier disclosed embodiment is directed to a method wherein the postage stamp is placed into the cavity of a mold, the mold is closed and subsequently filled with clear material. The resultant block of rigid plastic such as Lucite gives the appearance of a "floating" postage stamp.

Other types of devices and methods of making same are shown in the following U.S. patents listed hereinbelow showing various variations of molding articles in clear plastic material.

| U.S. Pat. Nos. | |
|---|---|
| 1,693,561 | 4,139,654 |
| 2,073,844 | 4,263,734 |
| 3,919,173 | 4,307,527 |
| 4,087,570 | 4,499,127 |
| 4,100,010 | |

While these various prior art structures and methods disclose the embedded various types of articles, none of them show the type of structure which can be used in conjunction with the devices of the present invention.

SUMMARY OF THE INVENTION

The invention is directed to a combination of structural elements which form an ornamental device which may be used to display postage stamps. A particular feature of the display device is that it may be used as a Christmas tree ornament. The manner of assembly and the particular disposition of the various parts with respect to each other are unique.

The display device comprises a rigid thin sheet planar substrate means with an envelope defined by sheets composed of a transparent material and having an outer edge. A postage stamp is disposed within the envelope between the sheets. The envelope is sealed along its outer edge to confine the postage stamp while allowing a visual examination of the postage stamp through the envelope.

The envelope is fixed in position on the rigid planar thin sheet substrate means and a clear material is disposed over the envelope to form a transparent dome-like structure through which the postage stamp may be viewed. The means for fixing the position of the envelope may include adhesive means for securing the envelope to the rigid planar thin sheet substrate member having a predetermined outer profile.

A first embodiment includes a clear material comprising epoxy resin contiguously extending over the entire envelope and rigid planar thin sheet substrate member to its predetermined outer profile.

In another embodiment, the clear material comprises a thin-walled bubble configuration laterally spaced from the envelope to form a shell over the substrate means.

In another embodiment, the rigid planar thin sheet substrate means comprises a single planar thin sheet substrate member having a predetermined outer profile and two displaying faces. An envelope containing a postage stamp is fixed to each of the substrate displaying faces.

In a still further embodiment of the invention, an envelope containing a postage stamp is fixed to one of the displaying faces. The clear material comprises an epoxy resin contiguously extending over the entire envelope and rigid planar substrate member to its predetermined outer profile. Indicia is disposed on the other side of the displaying faces to describe the significance of the postage stamp located on the obverse side thereof.

In another embodiment, the rigid planar thin sheet substrate means comprises first and second planar thin sheet substrate members each having a predetermined outer profile. The first planar thin sheet substrate member supports an envelope containing a postage stamp. The clear material comprises an epoxy resin contiguously extending over the entire envelope and rigid planar thin sheet substrate member to its predetermined outer profile. The first thin sheet substrate member is fixed to the second thin sheet substrate member which is larger than the first thin sheet substrate member. The second thin sheet substrate member has a predetermined outer profile and two displaying surfaces. Fixing means on the second thin sheet substrate member includes a recessed area located on one displaying face and has an outer peripheral shape to receive the first thin sheet substrate member registered therewith. The second thin sheet substrate member includes a precious metal along at least the displaying face carrying the first planar thin sheet substrate member with the postage stamp-containing envelope.

The method of making a display device in accordance with the invention includes providing rigid planar thin sheet substrate means and an envelope defined by sheets composed of transparent material having an outer edge. Adhesive means placed between the envelope and the rigid planar thin sheet substrate member secures the envelope to the rigid planar thin sheet substrate means having a predetermined outer profile.

In a specific embodiment of the method, the rigid planar thin sheet substrate means comprises first and second planar thin sheet substrate members each having a predetermined outer profile. The thin sheet substrate means providing step includes supporting an envelope containing a postage stamp on a displaying face of the second thin sheet substrate member and contiguously extending an epoxy resin over the entire envelope and rigid thin sheet substrate member to its predetermined outer profile. The first thin sheet substrate member is fixed to the second thin sheet substrate member which is larger than the first thin sheet substrate member.

When registered with a recessed area located on one displaying face of the second thin sheet substrate member, the first planar thin sheet member is secured within the recessed area. The recessed area has an outer peripheral shape corresponding to the first thin sheet substrate member registered therewith. The second thin sheet substrate member includes a precious metal along at least the displaying face carrying the first thin sheet substrate member with the postage stamp-containing envelope.

BRIEF DESCRIPTION OF THE DRAWINGS

Other objects of this invention will appear in the following description and appended claims, reference being made to the accompanying drawings forming a part of the specification wherein like reference characters designate corresponding parts in the several views.

DETAILED DESCRIPTION

Figure 1:
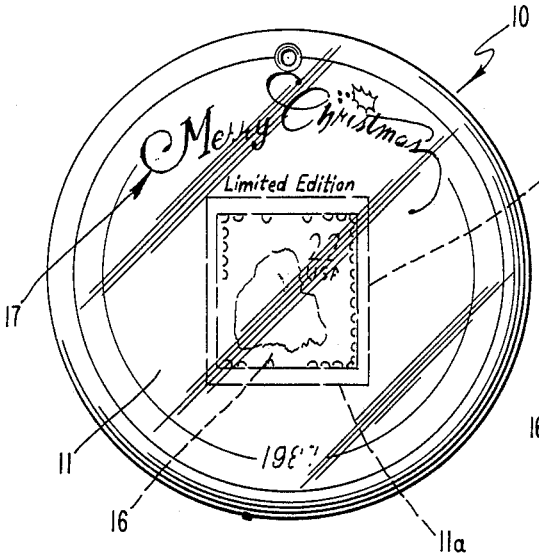
FIG. 1 is a front elevational view of a Christmas tree ornament according to the display device of the invention.
Figure 2:
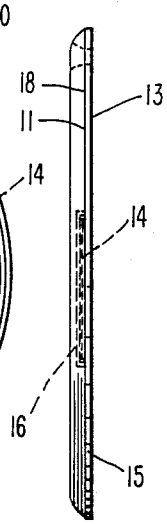
FIG. 2 is a right elevational side view of the display device shown in FIG. 1.
Figure 3:
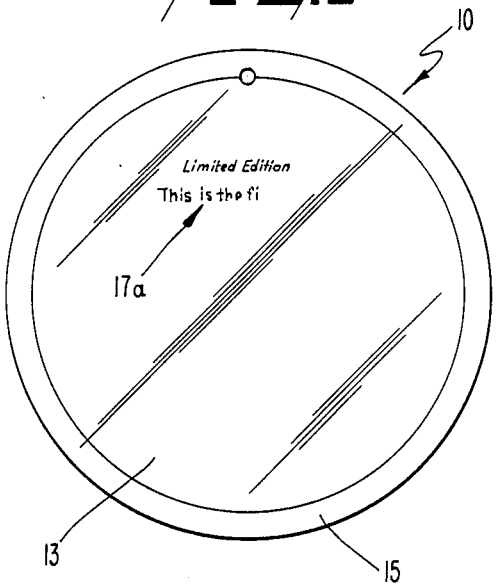
FIG. 3 is a rear elevational view of the display device as shown in FIG. 1.

The display device, generally designated 10, includes displaying faces 11 and 13. An envelope 14 having a postage stamp 16 disposed therein is made in accordance with my earlier U.S. Pat. No. 3,522,673 the disclosure of which is herein incorporated in its entirety by reference.

An adhesive material secures envelope 14 to display face 11 of a rigid thin sheet substrate member 15. The adhesive material may be any desired available adhesive mechanism to secure envelope 14.

A clear material 18 such as an epoxy resin or acrylic resin is poured to contiguously extend over the entire envelope 14 and rigid planar substrate member 15 to its predetermined outer profile as shown. Indicia 17 and **17*a* disposed on respective display faces 11 and 13 communicate a message and information regarding postage stamp 16. The clear epoxy resin material 18 forms a transparent dome-like structure through which postage stamp 16 may be viewed. A colored background 11*a* is imprinted on display face 11 to highlight postage stamp 16 in envelope 14**.

Figure 4:
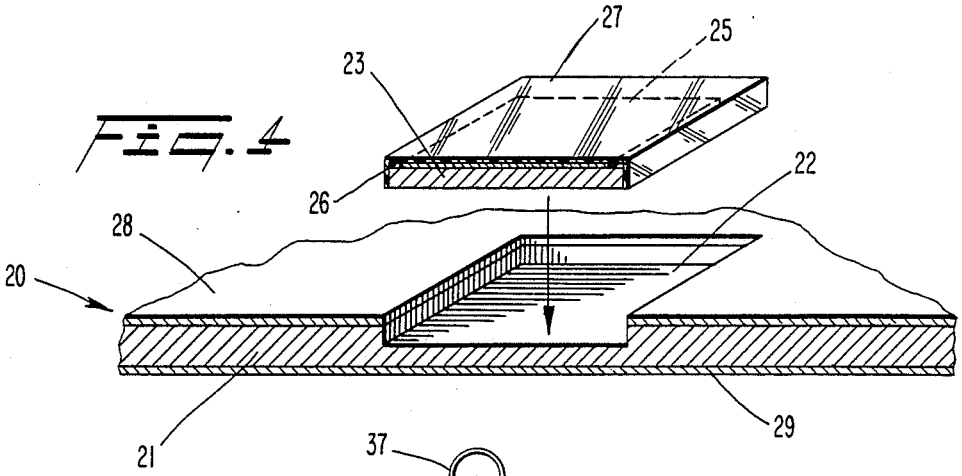
FIG. 4 is a fragmentary exploded sectional view of another embodiment of a display device made in accordance with the invention.

The embodiment of FIG. 4 discloses a device, generally designated 20, having a first rigid thin sheet substrate member 21 having a precious metal plated as layers 28 and 29 on respective sides thereof. This precious metal may be silver. Furthermore, the entire thickness of the substrate member 21 may be composed of a precious metal.

The first substrate member 23 is composed of a rigid thin sheet material and carries a envelope 25 having a postage stamp 27 disposed therein. An epoxy resin 26 forms a transparent dome-like structure over envelope 25 to the outer profile of the thin sheet substrate member 23 as shown.

The recessed area 22 has a shape corresponding to the outer profile of substrate member 23. An adhesive material may be placed between the substrate member 23 and the bottom of the recessed area 22 for securing the postage stamp-containing envelope 25 on the substrate member 21. A clear material 26 forms a dome-like structure as in the earlier embodiment. As shown, the first thin sheet substrate member 23 is registered with the recessed area 22. The outer shape of the display device 20 may be circular as shown in the earlier embodiment or it may be shaped in any desired configuration defining the outer profile of rigid member 21. Again, envelope 25 disposed on substrate member 23 is made in accordance with the process as disclosed with respect to the first embodiment discussed above.

Figure 5:
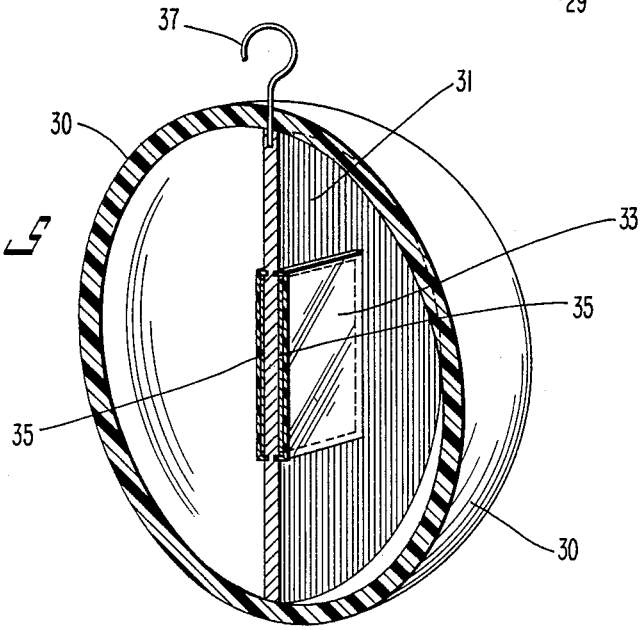
FIG. 5 is a cross-sectional perspective view of a third embodiment of a display device made in accordance with the invention.

FIG. 5 shows a further embodiment of a display device 30 in which a substrate member 31 carries a postage stamp-containing envelope 33 and 35 on two displaying surfaces thereof. The thin walled bubble like structure 30 forms a shell around substrate member 31 with a hook 37 used to hang this device at any desired location. Again, envelopes 33 and 35 are made in accordance with the process disclosed regarding the earlier embodiments. The material of the substrate members 15, 21, 23 and 31 may be metallic such as aluminum or any other type of rigid thin sheet substrate for carrying the postage stamp-containing envelope configurations as shown in the various embodiments of this invention.

In each of the embodiments, the rigid thin sheet substrate members 15, 21, 23 and 31 range in thickness from 1/32 to 3/32 of an inch in thickness. The thickness will vary depending upon the material being used and the particular type of display device being fabricated.

While the display device has been shown and described in detail, it is obvious that this invention is not to be considered as limited to the exact form disclosed, and that changes in detail and construction may be made therein within the scope of the invention without departing from the spirit thereof.

Having thus set forth and disclosed the nature of this invention, what is claimed is:

1. A combination comprising:

(a) rigid planar thin sheet substrate means, (b) an envelope defined by sheets composed of transparent material and having an outer edge, (c) a postage stamp disposed within the envelope between the pliable sheets, (d) the envelope being sealed along its outer edge to confine the postage stamp while allowing a visual examination of the postage stamp through the envelope, (e) the rigid planar thin sheet substrate means including first and second planar thin sheet substrate members each having a predetermined outer profile, (f) fixing means securing the position of the envelope on the first rigid planar thin sheet substrate member, (g) said first thin sheet substrate member being fixed to the second thin sheet substrate member which is larger than the first thin sheet substrate member, and (h) a clear material disposed over the envelope to form a transparent dome-like structure through which the postage stamp may be viewed.

2. The combination as defined in claim 1 wherein said fixing means includes adhesive means for adhering the envelope to the first rigid planar thin sheet substrate member.

3. The combination as defined in claim 2 wherein the clear material comprises an epoxy resin contiguously extending over the entire envelope and rigid planar substrate member to said predetermined outer profile.

4. The combination as defined in claim 2 wherein the clear material comprises a thin-walled bubble configuration laterally spaced from the envelope to form a shell over the thin sheet substrate means.

5. The combination as defined in claim 1 wherein the second rigid planar thin sheet substrate member comprises a single planar thin sheet having a predetermined outer profile and two displaying faces.

6. The combination as defined in claim 5 wherein there are two first rigid planar thin sheet members each supporting an envelope containing a postage stamp, one of the first rigid planar thin sheet members is fixed to each of the displaying faces.

7. The combination as defined in claim 5 wherein the first rigid planar thin sheet member supporting the envelope containing a postage stamp is fixed to one of the displaying faces, the clear material comprises an epoxy resin contiguously extending over the entire envelope and first rigid planar thin sheet substrate member to its predetermined outer profile, and indicia is disposed on the other of said displaying faces.

8. The combination as defined in claim 1 wherein the clear material comprises an epoxy resin contiguously extending over the entire envelope and rigid planar thin sheet substrate member to said predetermined outer profile of said first planar thin sheet substrate member.

9. The combination as defined in claim 8 wherein the second thin sheet substrate member has a predetermined outer profile and two displaying faces, second fixing means on the second thin sheet substrate member includes a recessed area located on one displaying face and having an outer peripheral shape to receive the first thin sheet substrate member registered therewith.

10. The combination as defined in the claim 1 wherein the second thin sheet substrate member includes a precious metal disposed along at least the displaying face carrying the first thin sheet substrate member with the postage stamp-containing envelope.

11. A method of making an ornamental device, said method comprising:

(a) providing first and second rigid planar thin sheet substrate members, (b) providing an envelope defined by sheets composed of transparent material and having an outer edge, (c) disposing a postage stamp within the envelope between the pliable sheets, (d) sealing the envelope along its outer edge to confine the postage stamp while allowing a visual examination of the postage stamp through the envelope, (e) fixing the position of the envelope securely on the first rigid planar thin sheet substrate member, and (f) disposing a clear material over the entire first substrate member including the envelope to form a transparent dome-like structure through which the postage stamp may be viewed, (g) fixing said first thin sheet substrate member to the second thin sheet substrate member which is larger than the first thin sheet substrate member.

12. The method as defined in claim 11 wherein said fixing step includes placing adhesive means between the envelope and the first rigid planar thin sheet substrate member to secure the envelope to the first rigid planar thin sheet substrate member having a predetermined outer profile.

13. The method as defined in claim 11 wherein the first and second planar thin sheet substrate members each has a predetermined outer profile, said clear material disposing step includes contiguously extending an epoxy resin over the entire envelope and rigid planar thin sheet substrate member to said predetermined outer profile.

14. The method as defined in claim 13 wherein the second thin sheet substrate member has a predetermined outer profile and two displaying faces, said first thin sheet substrate member fixing step includes providing a recessed area on one displaying face, said recessed area having an outer peripheral shape to receive the outer profile of the first thin sheet substrate member registered therewith.

15. The method as defined in claim 14 wherein the substrate member providing step includes disposing a precious metal along at least the displaying face carrying the first thin sheet substrate member with the postage stamp-containing envelope.

16. The method as defined in claim 11 wherein the substrate member providing step includes producing means for hanging the combination in a suspended manner.

17. The method as defined in claim 16 wherein the hanging means producing step includes forming an opening extending through the two displaying faces of the second thin sheet substrate adjacent the outer profile thereof.

* * * * *